US005080620A

United States Patent [19]

Reden

[11] Patent Number: 5,080,620

[45] Date of Patent: Jan. 14, 1992

[54] WATER SKI BOARD

[76] Inventor: Steven S. Reden, P.O. Box 554, Valley Center, Calif. 92082

[21] Appl. No.: 624,638

[22] Filed: Dec. 10, 1990

[51] Int. Cl.[5] ..... A63C 5/03

[52] U.S. Cl. ..... 441/68; 441/73; 114/253

[58] Field of Search ..... 114/253; 441/65, 68, 441/69, 73, 79; 280/606, 607, 608, 609, 12 H, 12 F, 12 A, 818, 14.1, 14.2, 14.3, 900, 15

[56] References Cited

U.S. PATENT DOCUMENTS

| | | | |
|---|---|---|---|
| 2,735,115 | 2/1956 | Dees | 441/65 |
| 2,841,406 | 2/1958 | Brandon | 441/65 |
| 2,958,875 | 11/1960 | McClain | 441/65 |
| 3,103,673 | 9/1963 | Martin | 441/68 |
| 3,142,075 | 7/1964 | Hill | 114/253 |
| 3,319,276 | 5/1967 | Penney | 441/68 |
| 3,380,090 | 4/1968 | Kenmuir | 114/253 |
| 4,951,960 | 8/1990 | Sadler | 441/65 |

*Primary Examiner*—Jesus D. Sotelo
*Assistant Examiner*—Stephen P. Avila
*Attorney, Agent, or Firm*—Brown, Martin, Haller & McClain

[57] ABSTRACT

The water ski board of the present invention is a generally flat U-shaped board with an upward curvature at its forward end portion. Two short tails extend backward from the body of the board slightly forward of which is fixed a pair of foot bindings. The tails are of greater thickness than the board with a taper beginning at the front of each tail. A U-shaped channel with a plurality of holes provided along its length is affixed to the top of the board along its center axis to permit the tow line to be attached at any of the holes. The variable attachment of the tow lines allows the board to plane at different speeds, depending on the weight of the rider in relationship to the direction of pulling force from the boat. On the bottom surface of each tail a semicircular tunnel is formed at the approximate center running parallel to the axis. On both sides of the tunnel a tube runs through the length of the tail parallel to the axis. The tube is open at both ends so that water enters the front of the tube at the taper of the tail and exits from the back of the tail. A fin is located in the center of the board on the axis on the bottom surface, slightly forward of the tails.

7 Claims, 2 Drawing Sheets

WATER SKI BOARD

BACKGROUND OF THE INVENTION

The sport of towing a rider on a water planing device behind a boat is well known. The types of devices may generally be divided into the categories of water skis and water planes or aquaplanes. In the categories of water skis the advantages of control and versatility are available. However, water skiing requires a development of sufficient strength to hold onto a tow rope while maintaining the skis in a parallel relationship and standing erect while doing both. This makes waterskiing a difficult and often frustrating sport for the beginner, requiring the simultaneous development of arm strength, leg strength and balance.

Water planes are generally a single flat, wide board on which the rider stands. In some versions, for example the water sports vehicle disclosed in U.S. Pat. No. 3,581,328 of Smith, the problem of direct force on the rider from the tow rope is alleviated by connecting the tow rope to the front of the vehicle and having a handle extending from the front for the rider to hold for stability without requiring a great deal of upper body strength. Typically, however the water planing devices fail to provide as much control as is available with water skis, requiring considerable skill to negotiate turns while remaining erect.

Several devices have been disclosed which are hybrids between the two aforementioned categories including the aquaplane of U.S. Pat. No. 2,841,805 issued to Roudebush and the U-shaped water ski described in U.S. Pat. No. 3,585,664 of Thompson. These devices primarily take parallel skis and join them by a rigid or semirigid crossbar at their front, thereby maintaining the skis in a permanent parallel relationship. Similar to water skis, these hybrid devices require a relatively high minimum speed to prevent the rider from sinking, further requiring a substantial amount of resistance to be overcome, thus considerable leg strength and balance, in order to initiate planing. Further, because of the fixed location of the tow rope attachment at the front of the device, the only possible means to adjust for different riders is variation of the length of the rope extension from the front of the device to the handles onto which the rider holds. No adjustment is provided for either the rider's weight or skill level, or for allowing the device to plane at different speeds.

It would be desirable to provide a water ski board for towing behind a boat or the like which may be used by beginners or accomplished skiers, by providing the stability needed by beginners as well as adjustability for speed and skill level for increasing the challenge and controllability for advanced skiers. It is to such a device that the present invention is directed.

SUMMARY OF THE INVENTION

It is an advantage of the present invention to provide a water ski board for towing behind a boat or the like which provides stability for beginning skiers by maintaining the parallel ski portions at a fixed separation and applying the direct pull of the tow rope to the front of the device thereby permitting the rider to concentrate on staying erect and steering without expending a great deal of upper body or leg strength.

It is a further advantage of the present invention to permit adjustability of the point at which the towing force is applied to compensate for the rider's weight and/or skill level.

It is still another advantage of the present invention to provide a water sport device with a high degree of stability and the ability to plane at very slow speeds.

Another advantage is to permit the creation of a rooster tail behind the device to enhance the entertainment value and visual effect achieved by the rider.

In an exemplary embodiment the water ski board of the present invention is a generally flat U-shaped board with an upward curvature at the semicircular forward end portion to prevent the board from digging into the water as it is towed. Two short tails extend backward from the body of the board, slightly forward of which is fixed a pair of foot bindings. The tails are of greater thickness than the board with a taper beginning at the front of each tail.

On an axis defined by a line bisecting the U-shape of the board at the forward end, a U-shaped channel with a plurality of holes provided along its length is affixed to the top of the board to permit the tow line to be attached at any of the holes. The variable attachment of the tow lines allows the board to plane at different speeds, depending on the weight of the rider in relationship to the angle of pulling force from the boat. The adjustable attachment also allows the rider to vary the length of the rope holding the handle depending on the height of the rider.

On the bottom surface of each tail a semicircular tunnel is formed at the approximate center running parallel to the axis. The tunnel permits the board to plane at very low speeds and gives stability at high speeds.

On both sides of the tunnel a tube runs through the length of the tail parallel to the axis. The tube is open at both ends so that water enters the front of the tube at the taper of the tail and exits from the back of the tail. The tubes provide additional stability and at high speeds, can produce a rooster tail out of the back of the board.

A fin is located in the center of the board on the axis on the bottom surface, slightly forward of the tails. The fin provides stability for turning and lateral movement control.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENT

Figure 1:
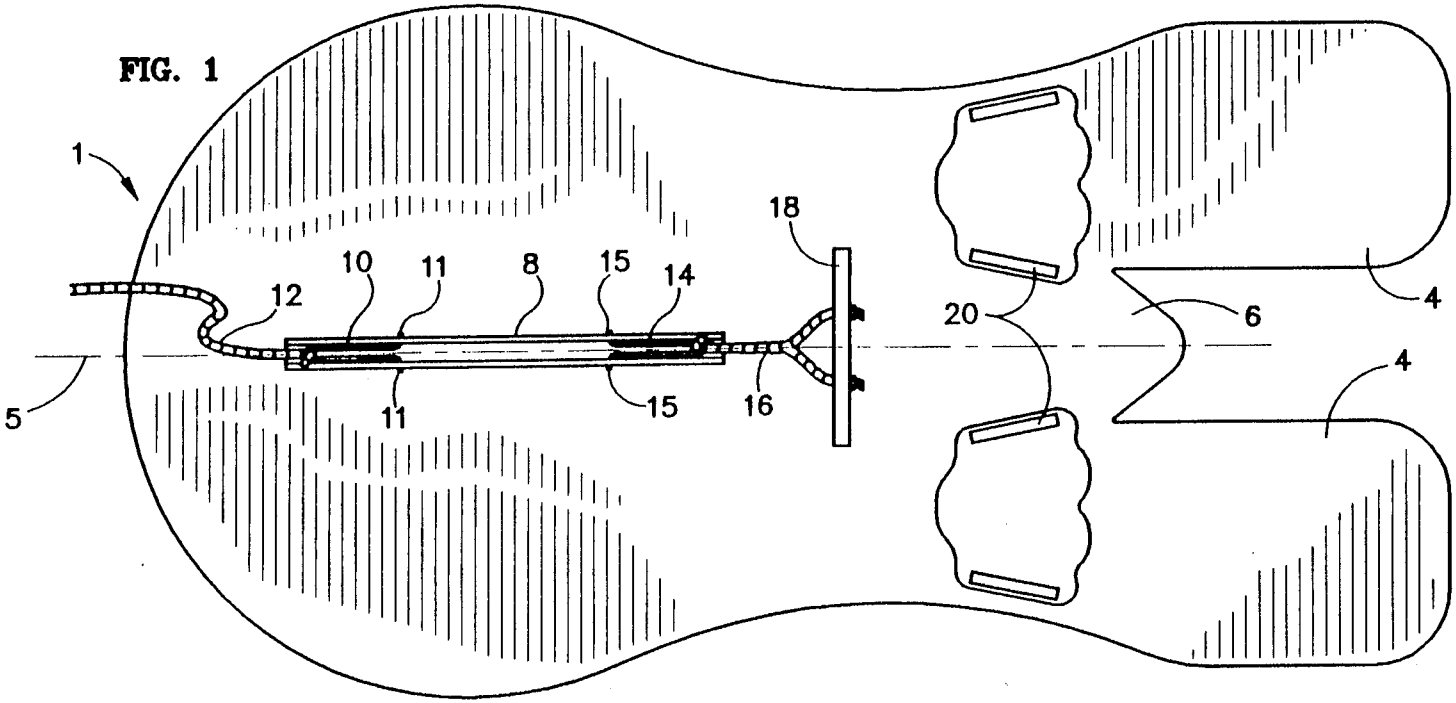
FIG. 1 is a top plan view of the water ski board according to the present invention.
Figure 2:
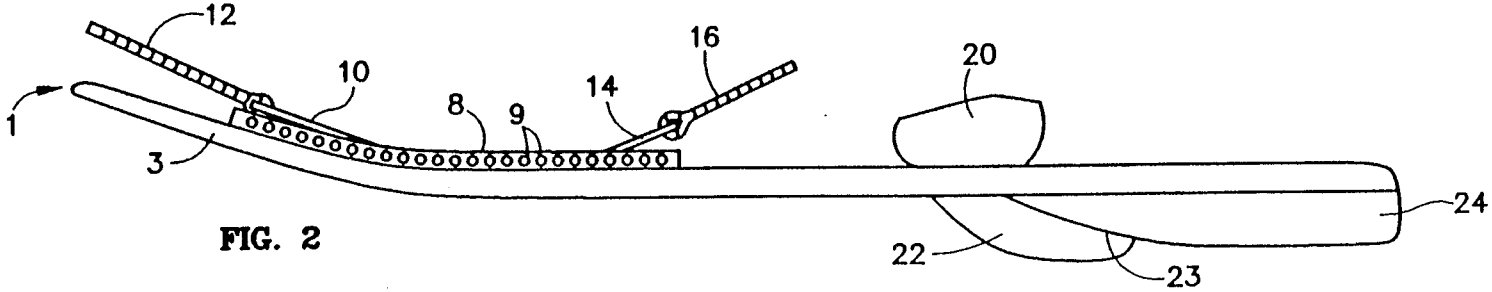
FIG. 2 is a side elevation view of the water ski board.
Figure 3:
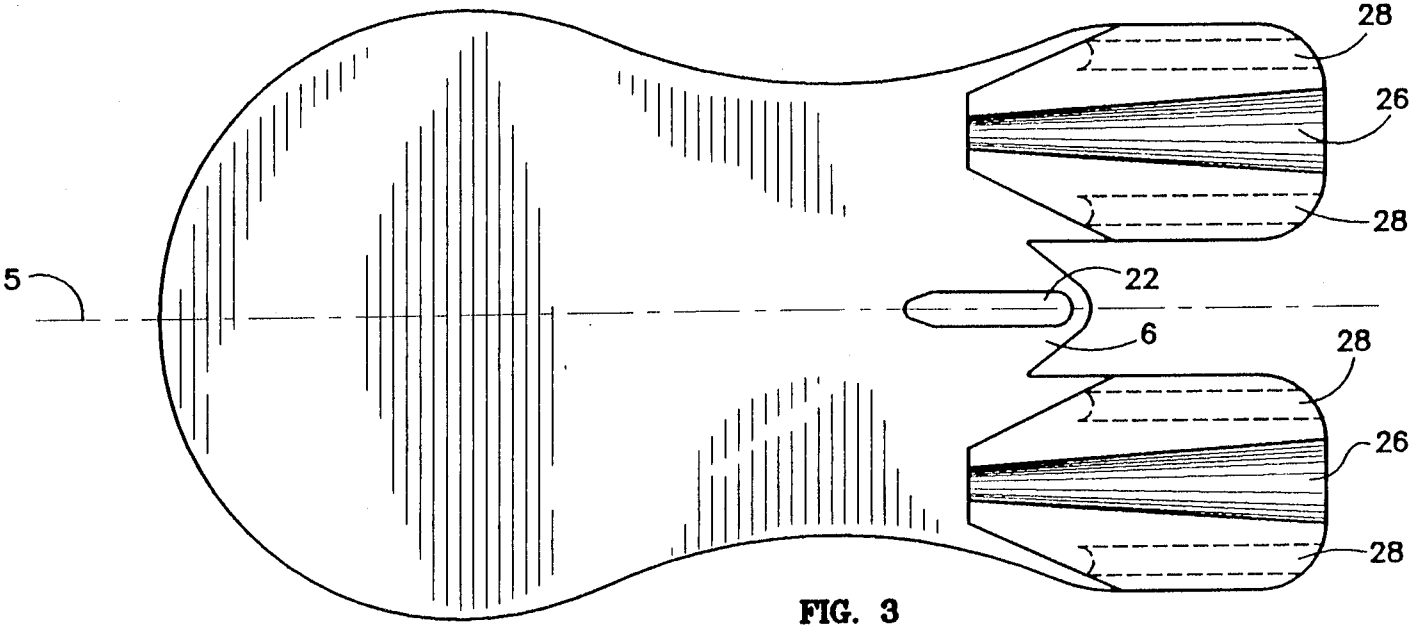
FIG. 3 is a bottom plan view of the water ski board.

As illustrated in FIGS. 1 through 3, the water ski board 1 comprises a generally U-shaped body 2 which curves up slightly at its front portion 3, a pair of tails 4 extending backward from the body 2, a fin extension 6 on the bottom side of which is attached a fin 22, a channel 8 and a pair of foot bindings 20.

Water ski board 1 is formed from plywood which is coated with fiberglass or other resinous sealant which provides a smooth, low friction water resistant surface. Alternately, water ski board 1 may be formed from a shaped foam core coated with fiberglass, a molded or machined plastic or similar polymer, or a composite of any of the above materials. Front portion 3 is curved upward to provide a good hydro-planing surface to prevent the front of the board from "pearling" or digging into the water, causing the board to flip forward.

The tails 4 extending backward from the U-shaped body 2 are located symmetrically on either side of an axis 5 bisecting the board 1 through its longitudinal center. The upper portion of each tail 4 is a continuation of the board of which U-shaped body 2 is formed. The bottom portion 24 of tail 4 slopes backward at taper 23 so that the tail 4 becomes thickest at its rearmost portion. The taper 23 and the thickest portion 24 may be created by further lamination or by molding or shaping. The tapers 23 provide a lifting action which causes the board 1 to plane.

On the top of U-shaped body 2, located directly over axis 5 is channel 8, which provides the attachment point for the tow rope 12 from the towing vehicle and for the handle 18 and rope 16 support for the rider. Channel 8 is a length of metal channel with a plurality of holes running down its length, with matching holes running down both sides of the channel 8. A rigid plastic or polymer may also be used.

In the preferred embodiment, a resilient metal clip 10 and 14 for the tow rope 12 and handle rope 16, respectively, is a U-shaped spring with feet 11 or 15 which extend approximately at right angles to the legs of the clips in opposite directions to each other. When the legs of the clip 10 are squeezed together, the feet 11 may be removed from and placed into any set of holes desired in the channel 8, placement depending on the weight and/or skill level of the rider. Clip 14 may be similarly adjusted to compensate for the rider's height and/or skill level, permitting variability in the rider's lean angle. It should be noted that any other type of fastening which will firmly hold the ropes in place while retaining its adjustability will satisfy the desired purpose. Suggested alternatives include locking pins or cotter pins.

Finally, on the top surface of the board 1, a pair of foot bindings 20 is positioned symmetrically along axis 5, just forward of tails 4. The foot bindings 20 or boots generally are made of rubber or a rubber-like material to provide flexibility and comfort for retention of the rider's feet.

On the bottom of board 1, shown in FIG. 3, fin 22 is attached on the underside of fin extension 6 along axis 5. Fin 22 is narrow in its cross-section with a taper running from front to back, as is known in the art. The fin is preferably fiberglass or plastic and may be glassed onto the board for permanent placement or may be removably mounted as a separate component. Fin 22 provides lateral stability and steering control, preventing undesired sliding from side to side.

Figure 4:
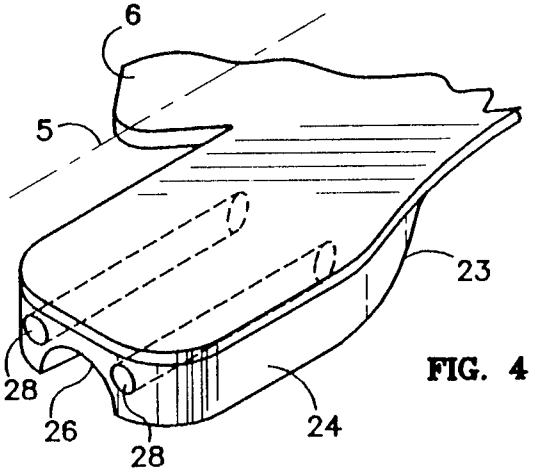
FIG. 4 is a perspective view of a tail of the water ski board.

The lower portions 24 of tails 4 are tapered to the board's thickest point, as illustrated in FIG. 4. Along the center of each tail 4 a tunnel 26 runs parallel to axis 5. The tunnel 26 tapers in width being narrowest at its forward portion where water enters the tunnel 26 and widest at the rear of tail 4 where water exits. The tunnel 26 provides a stabilizing vacuum-like downward pull which provides increased stability at high speeds and enables planing while running at very low speeds.

In each tail 4 in lower portion 24, running on either side of tunnel 26 is a tube 28 which provides an open passage from the front of taper 23 to the rearmost portion of the board. While providing additional stability at any speed by pulling down the back of the board, the tubes 23 are especially effective at higher speeds, permitting formation of a rooster tail running from the rear of each tail, thereby enhancing the visual impact created by the rider. Tubes 28 are preferably acrylic or similar smooth polymers which are inserted through the lower portion 24.

The water ski board of the present invention provides a highly stable water sport device for towing behind a boat which allows beginning skiers the chance to develop balance and steering ability without requiring a great deal of upper body or leg strength. The water ski board is adaptable to the full spectrum of skill levels permitting adjustment of the location of towing force to vary speed and to compensate the rider's weight and/or skill level. The same devices which provide enhanced stability for the beginner provide entertainment and challenge for the advanced skier by allowing controllability and special visual effects to be created.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A water ski board for towing behind a boat while being ridden by a rider, said water ski board comprising:

a generally U-shaped body having a top surface and a bottom surface;

two short tails integral with said body extending from a back of said body, each tail of said two tails having a taper at its forward portion, said taper being thinnest where said tail meets said body and thickest at a rearmost portion of said tail;

two foot bindings disposed forward of said tails on said top surface, said two foot bindings being attached symmetrically on either side of an axis running lengthwise through a center of said body;

at least one fin disposed on said bottom surface of said body parallel to said axis at said back of said body;

a channel attached at said front portion on said top surface along said axis, said channel having a plurality of holes disposed therein along its length, each hole for alternately receiving a tow rope from said boat and releasably retaining said tow rope therein; and a handle extending from said channel for grasping by said rider.

2. A water ski board as in claim 1 wherein said each tail has a tunnel disposed on its bottom surface, said tunnel running the length of said tail.

3. A water ski board as in claim 1 wherein at least one tube is disposed in said each tail parallel to said axis, said tube having a forward open end extending through said taper and a rearmost open end at said rearmost portion of said tail.

4. A water ski board as in claim 1 wherein said body has an upward curvature at a front portion thereof.

5. A water ski board as in claim 1 wherein said water ski board consists of laminated plywood.

6. A water ski board as in claim 1 wherein said water ski board consists of a wood and fiberglass composite.

7. A water ski board as in claim 3 wherein two said tubes are disposed in said each tail.

* * * * *